US007922018B2

(12) United States Patent
Granger et al.

(10) Patent No.: US 7,922,018 B2
(45) Date of Patent: Apr. 12, 2011

(54) BOTTLE CLOSURE WITH IMPROVED THREAD

(75) Inventors: Jacques Granger, Sainte Terre (FR); Jean-Marie Bourreau, le Pizou (FR)

(73) Assignee: Amcor Flexibles Capsules France, Paris (FR)

( * ) Notice: Subject to any disclaimer, the term of this patent is extended or adjusted under 35 U.S.C. 154(b) by 1212 days.

(21) Appl. No.: 10/561,818

(22) PCT Filed: Jun. 23, 2004

(86) PCT No.: PCT/FR2004/001568

§ 371 (c)(1),
(2), (4) Date: Dec. 21, 2005

(87) PCT Pub. No.: WO2005/000697

PCT Pub. Date: Jan. 6, 2005

(65) Prior Publication Data

US 2007/0095782 A1 May 3, 2007

(30) Foreign Application Priority Data

Jun. 24, 2003 (FR) ..... 03 07610

(51) Int. Cl.
*B65D 53/00* (2006.01)

(52) U.S. Cl. ..... 215/349; 215/344; 215/DIG. 1

(58) Field of Classification Search ..... 215/349, 215/350, 351, 277, 21, 344, DIG. 1
See application file for complete search history.

(56) References Cited

U.S. PATENT DOCUMENTS

| | | | | | |
|---|---|---|---|---|---|
| 3,664,536 | A | * | 5/1972 | Emery | 215/251 |
| 4,651,886 | A | * | 3/1987 | Stull | 215/329 |
| 4,785,952 | A | * | 11/1988 | Obadia | 215/329 |
| 5,143,763 | A | * | 9/1992 | Yamada et al. | 428/36.2 |
| 5,259,522 | A | * | 11/1993 | Morton | 215/344 |

(Continued)

FOREIGN PATENT DOCUMENTS

DE 73 07 422 2/1977

(Continued)

OTHER PUBLICATIONS

List of material densities, http://www.simetric.co.uk.*

(Continued)

*Primary Examiner* — Anthony Stashick
*Assistant Examiner* — James N Smalley
(74) *Attorney, Agent, or Firm* — Young & Thompson

(57) ABSTRACT

A closure, embodied to cooperate with a neck of a container, the neck, having a wide mouth on the upper part thereof, an external thread and a tapering piece on the lateral wall, for sealing the closure which includes a) an external body having an external head and skirt, b) an insert, enclosed within the body and fixed thereto, including an internal head and skirt, provided with an internal thread, for cooperation with the external thread of the neck and c) a sealing joint, forming an inset piece, fixed to the insert. The joint has a central piece and a border piece. The insert includes a radial compression element, for the sealing joint against the neck, such that when the bottle closure is screwed to the neck, the border is compressed radially between the insert and the neck.

15 Claims, 7 Drawing Sheets

U.S. PATENT DOCUMENTS

| | | | | |
|---|---|---|---|---|
| 5,285,913 | A * | 2/1994 | Morton | 215/349 |
| 5,356,021 | A * | 10/1994 | McBride et al. | 215/349 |
| 5,743,420 | A * | 4/1998 | Loffler et al. | 215/270 |
| 5,875,909 | A * | 3/1999 | Guglielmini | 215/350 |
| 5,971,179 | A * | 10/1999 | Christmas et al. | 215/21 |
| 6,403,173 | B1 | 6/2002 | Peyrin et al. | |
| 6,783,015 | B1 * | 8/2004 | Bosl et al. | 215/349 |
| 6,929,137 | B1 | 8/2005 | Granger et al. | |
| 7,210,592 | B1 * | 5/2007 | Dautreppe | 53/412 |
| 2003/0021919 | A1 | 1/2003 | Granger et al. | |

FOREIGN PATENT DOCUMENTS

| | | |
|---|---|---|
| EP | 0 770 559 | 5/1997 |
| EP | 0 987 190 | 3/2000 |
| EP | 1 295 804 | 3/2003 |
| FR | 2 793 216 | 11/2000 |
| WO | WO 01/07334 | 2/2001 |

OTHER PUBLICATIONS

Appendix A, Examiner's annotated drawing.*

* cited by examiner

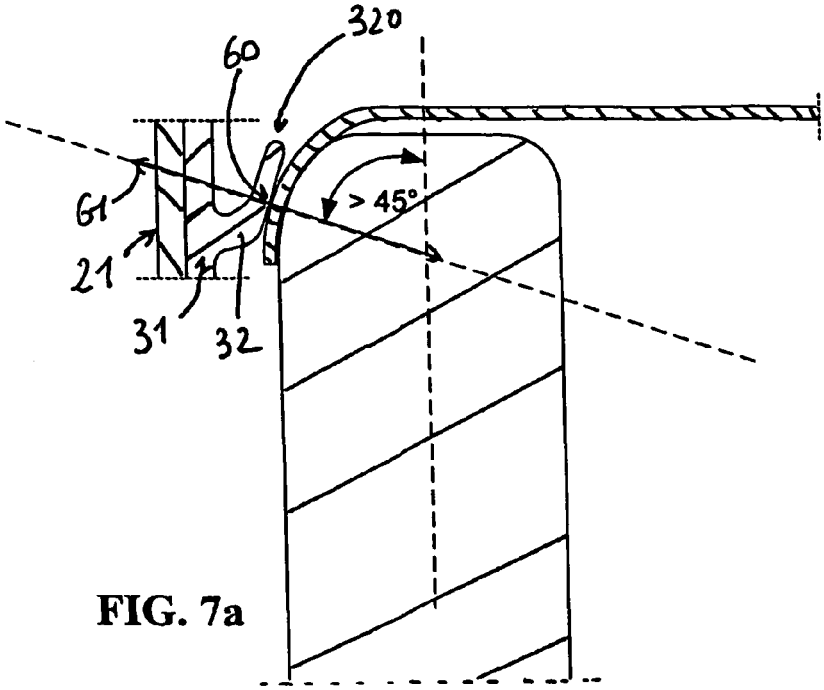
FIG. 7a
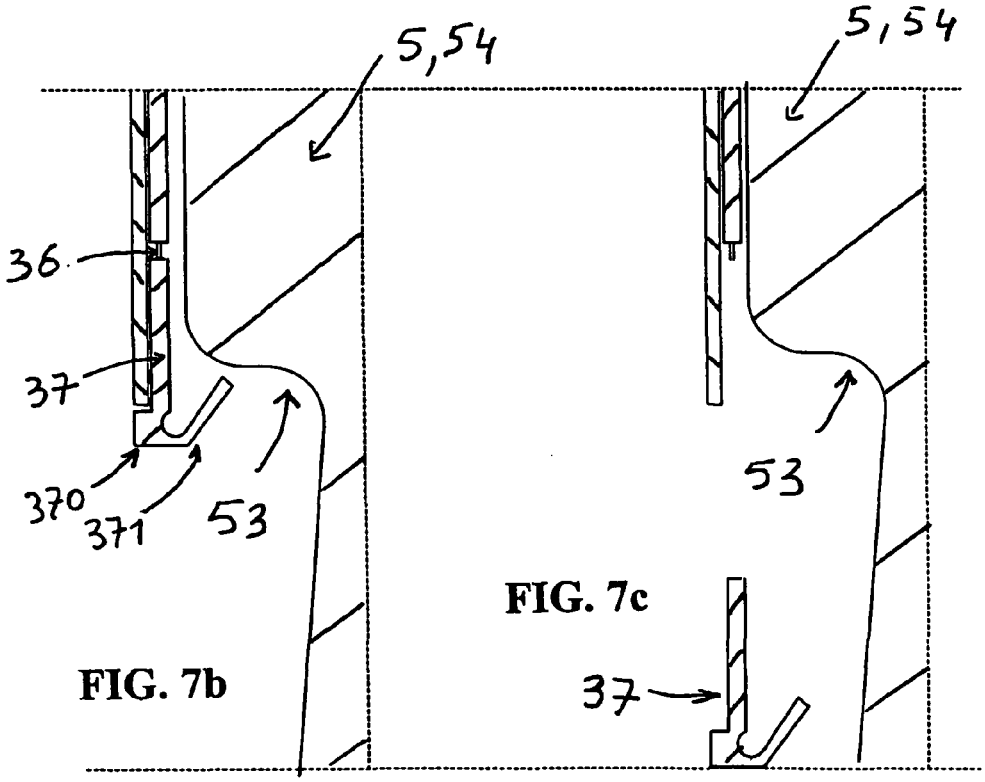
FIG. 7b
FIG. 7c

BOTTLE CLOSURE WITH IMPROVED THREAD

DOMAIN OF THE INVENTION

The invention relates to the domain of metal closing caps with plastic inserts, typically designed for closing bottles with screw caps.

STATE OF THE ART

A number of closing caps with metal shells and plastic inserts are already known, the metal shell being used for capping by crimping the cap onto the threaded glass ring, and the threaded insert performing the cap open-close function by screwing—unscrewing the cap, and creating the leak tight closing seal.

Thus, the applicant's patents include:

- French patent No. 2 763 046 that discloses a means of fixing the insert to the metal shell,
- French patent No. 2 792 617 that discloses composite closing caps in which the appearance of the cap can be modified by keeping the same insert and therefore without needing to modify the technical functions of the cap,
- French patent No. 2 793 216 that discloses composite closing caps with an add-on seal,
- French patent No. 2 803 827 that discloses closing caps with a thin insert.

PROBLEMS THAT ARISE

There are several types of requirements and problems due to closing caps according to the state of the art:

- firstly, closing caps must have the required seal and in particular a very good seal if used for packaging of white wine,
- secondly, this seal must be obtained without a high required screwing/unscrewing torque, because it is important to be able to unscrew closing caps by hand, particularly during the first opening and obviously without requiring any tools whatsoever,
- finally, it is important that these sealing and screwing/unscrewing torque values can be obtained under high speed industrial conditions for capping, without significant waste, in other words accepting relatively high tolerances on the exact dimensions of glass bottles to be capped.

The invention is intended to develop a closing cap that satisfies these three objectives.

DESCRIPTION OF THE INVENTION

According to the invention, the screw closing cap designed to cooperate with a neck of a receptacle, typically a bottle designed to contain an alcoholic drink such as wine, the said neck forming a mouth lip on the upper part and comprising an outer thread on its sidewall and a recessed part on which the said cap will be crimped, comprises a) a typically metal outer shell, typically including an outer head and an outer skirt, b) an insert typically made of plastic, the said insert contained in the said shell and fixed to the said shell, comprising a head and a skirt provided with an inner thread designed to cooperate with the outer thread of the said neck, and c) a seal typically forming an add-on part fixed to the said insert, the said seal comprising a central part and a peripheral part or border, and is characterised in that the said insert comprises a radial compression means of the said seal in contact with the said neck, such that when the said closing cap is screwed to the said neck, the said border is compressed radially between the said insert and the said neck, and thus the seal and the opening torque of the said cap are to a large extent independent of the axial position of the said cap with respect to the said neck.

The applicant had already observed that many problems encountered in capping using caps according to the state of the art were due particularly to slight variations in the height of the bottles to be capped, or possibly a small difference in the axial distance between the cap and the mouth lip, particularly due to the normal clearance of cap devices, which were the cause of a variation in the axial compression of the seal on the neck mouth lip, and consequently a variable seal and a variable screwing torque.

Thus, following his observations, the applicant developed a cap in which the add-on seal is compressed radially, and on an industrial capping line he observed that firstly a greater tolerance was possible on the axial position of the cap with respect to the mouth lip while still obtaining the required seal, and secondly the screwing-unscrewing torque was approximately constant and remained within the normal range of values, without the need to compress the seal in the axial direction.

Furthermore, the use of such a cap enabled higher capping rates, largely due to this greater tolerance.

According to the invention, radial compression is a compression comprising a preponderant radial component, which assumes a compression force applied along a compression direction at an angle of more than 45° from the vertical, the angle being 90° in the case of pure radial compression and 0° in the case of a pure axial compression.

DESCRIPTION OF THE FIGURES

All figures are related to the invention.

In FIG. 3*a*, the cap (1) is at an axial distance H1>H0 from the mouth lip (50) of the neck (5), but this does not modify the height R1 of the overlap area (60).

In FIG. 3*b*, the cap (1) is at an axial distance H2<H0 from the mouth lip (50) of the neck (5), but this does not modify the height R1 of the overlap area (60).

Figure 4A:
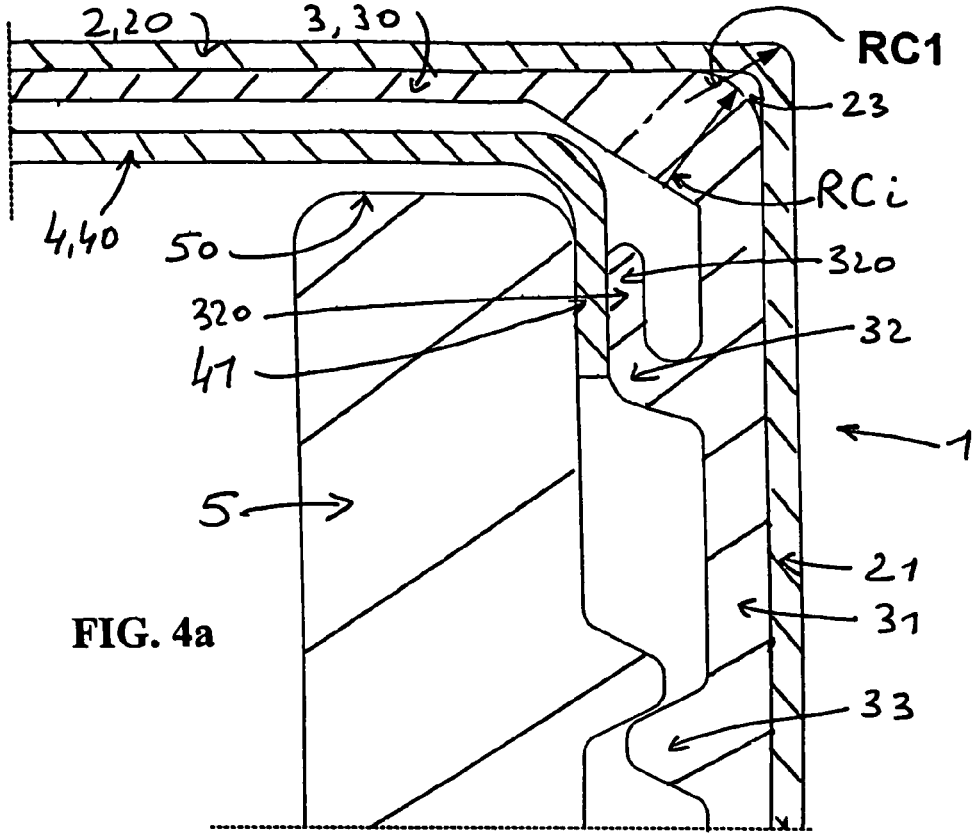
In FIG. 4*a* that corresponds to FIG. 2*c*, the metal shell (2) has a radius of curvature RC1 at the junction between the outer head (20) and the outer skirt (21) that is less than the radius of curvature RC2 of the metal shell (2) in FIG. 2*c* or FIG. 4*b*, the insert (3) being the same in both cases.
Figure 4B:
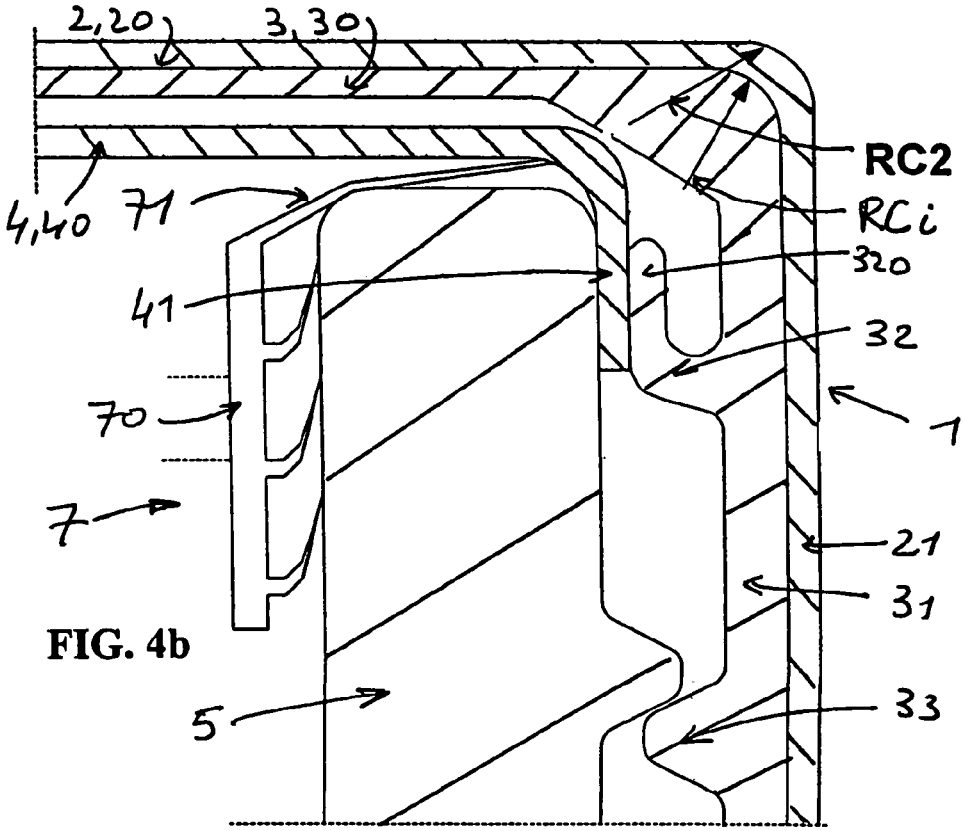

According to FIG. 4*b*, the cap (1) is fixed to a pouring spout (7), the flared upper part (71) of which is folded down onto the mouth lip (50) of the neck.

Figure 5A:
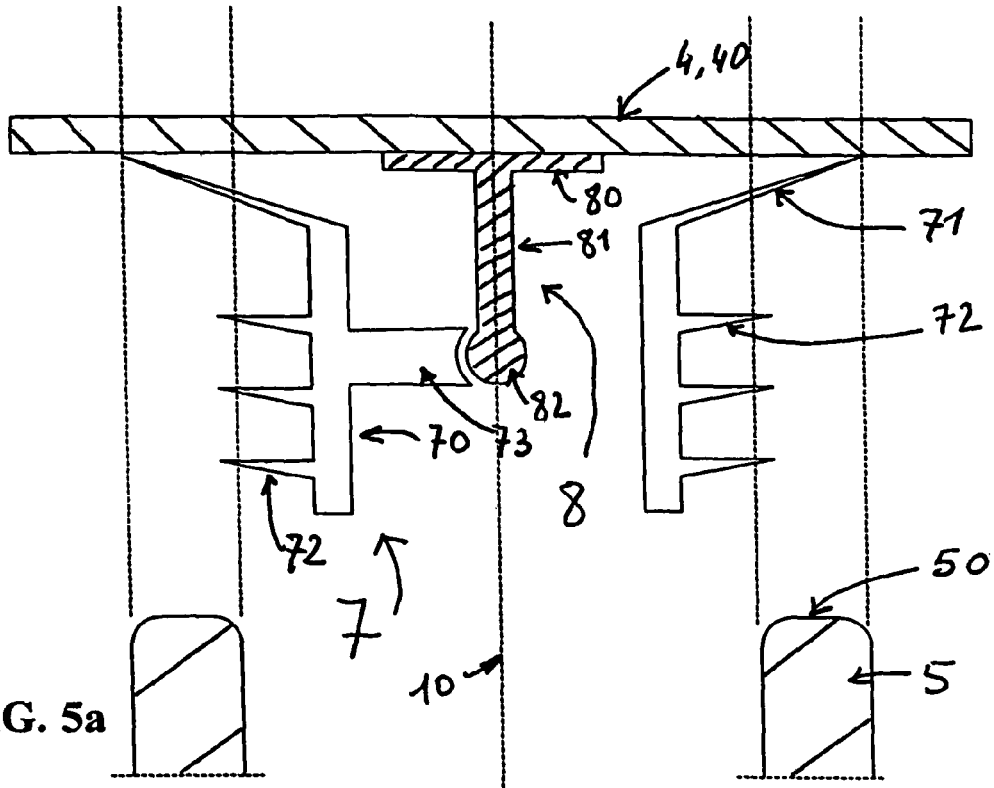

FIG. 5*a* shows an axial section of the reversible fixing of the pouring spout (7) with the central part (40) of the seal (4) obtained using a support part (8), the pouring spout comprising a plurality of fixing arms (73) cooperating reversibly with the said support part (8) fixed to the central part (40) of the seal (4).

Figure 5B:
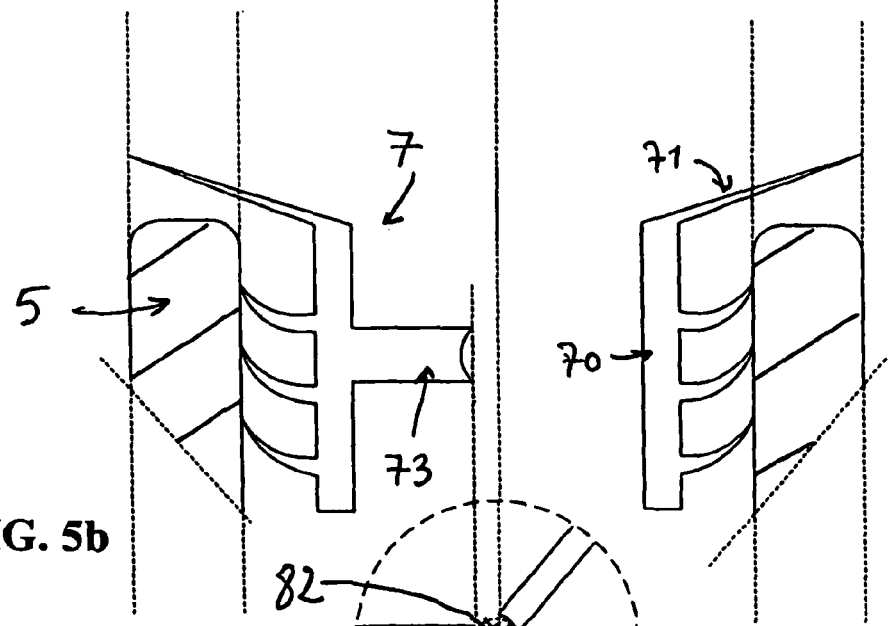

FIG. 5*b* shows an axial section of the pouring spout (7) fixed to the neck (5) after unscrewing of the cap (1).

Figure 5C:
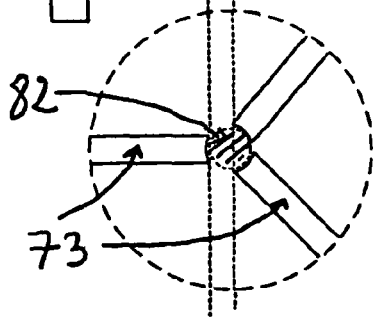

FIG. 5*c* is a partial view in a horizontal plane showing the fixing arms (73) of the pouring spout (7) cooperating with the head (82) of the support part (8).

Figure 6:
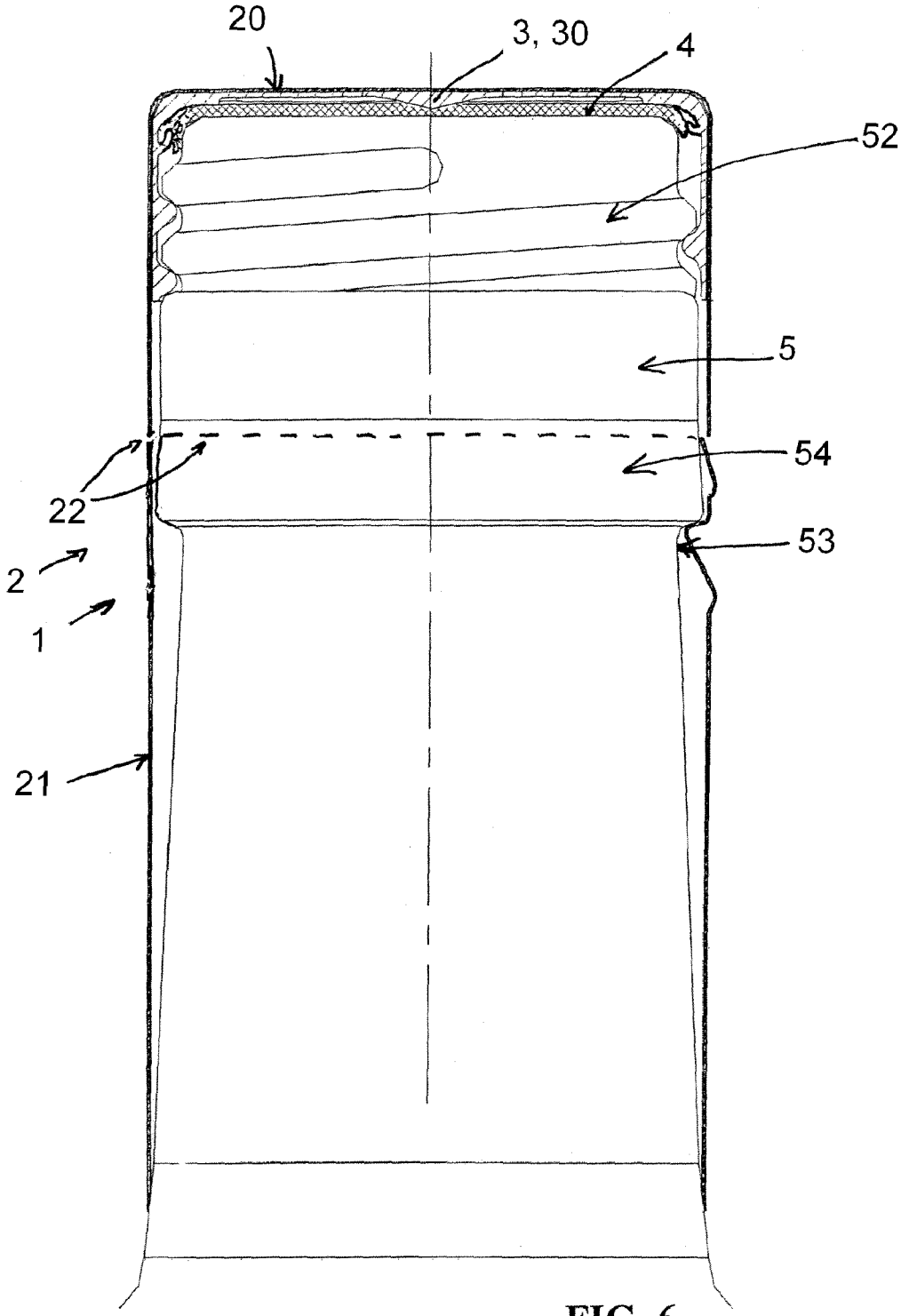

FIG. 6 is an axial sectional view of a cap (1) shown screwed onto a neck (5), in a lateral view.

The cap (1) on the left part of the figure is shown screwed rather than crimped, and on the right part the cap (1) is shown crimped, a portion of the outer skirt (21) having been pushed under the recessed part (53) of the neck (5) during capping.

FIG. 7*a* is a diagrammatic axial sectional view of radial compression (6) of the seal (4) in contact with the neck (5).

FIGS. 7*b* and 7*c* are diagrammatic partial axial views illustrating the case in which the insert fixes the cap (1) to the neck (5) due to a plurality of hooks (371) of a lower part (37) cooperating with the recessed part (53) of the neck (5), and includes a means of detecting a first opening due to a line of weakness (36) formed by a plurality of connecting strips connecting the lower part (37) to the rest of the insert (3).

FIG. 7*b* corresponds to the cap (1) screwed before being opened for the first time, while FIG. 7*c* illustrates detachment of the said lower part (37) following a first opening causing rupture of the connecting strips along the line of weakness (36).

DETAILED DESCRIPTION OF THE INVENTION

According to the invention, so as to form the said radial compression means (6):

a) the said inner skirt (31) may comprise a circular tab (32) with an axial spacing equal to h1 from the said inner head (30) forming the bottom of the said insert, the said distance h1 typically varying from 0.5 mm to 5 mm, so as to form an annular groove (35) with an axial height equal to at least the thickness e of the said seal (4), the said annular groove (35) being limited at its top part by the said tab (32) and at its lower part typically by the said thread (33), the said tab (32) having a radial width 1 typically varying from 0.2 mm to 2 mm, b) the diameter of the said seal (4) may be chosen such that the said edge (41) is capable of cooperating with the said annular groove (35), the said seal (4) having an annular overlap area with the said tab and typically with the said thread called the upper area and the lower area respectively, so that the said seal (4) remains fixed to the said insert (3) before the said cap (1) is screwed onto the said neck (5), or after the said cap (1) is unscrewed from the said neck (5), c) when the said cap (1) is screwed onto the said neck (5), the said tab (32) or a flexible radial end (320) of the said tab (32) and the said edge (41) of the said seal (4) can cooperate, the said tab (32) or the said flexible radial end (320) applying the said radial compression (6) on the said edge (41), so as to apply the said edge in contact with the said neck (5) and typically an upper part (51) of the said neck, forming an overlap area (60) between the said edge (41) and the said tab or radial end (320) inclined at more than 45° from the horizontal, thus sealing the said cap (1) screwed to the said neck (5).

FIG. 7*a* illustrates the case of an overlap area forming an angle of approximately 60° from the horizontal.

In some cases, this angle may be as large as 80° and possibly even 90° in the case in which the tab (32) is at a sufficient axial distance from the inner head (30) of the insert so as to face the vertical part of the said upper part (51) of the neck (5).

Figure 1A:
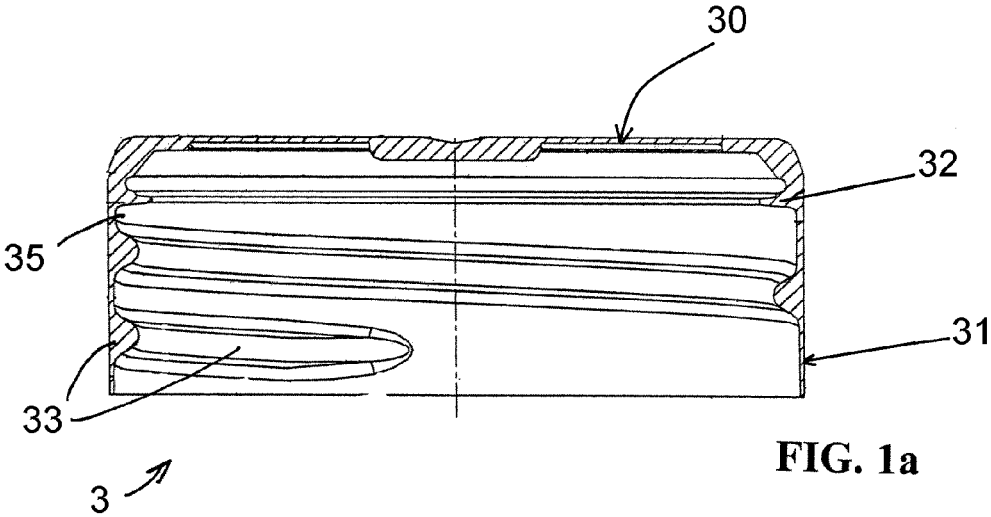
FIG. 1*a* is a view of an axial section of an insert (3) without its seal (4).
Figure 1B:
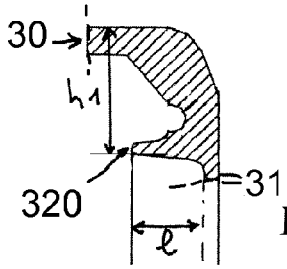
FIG. 1*b* is an enlarged view of part of the insert in FIG. 1*a* (part at the top left).
Figure 1C:
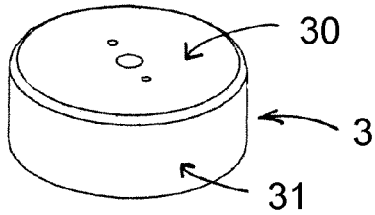
FIG. 1*c* is a lateral top perspective view of an insert (3), at a smaller scale than the insert in FIG. 1*a*.
Figure 1D:
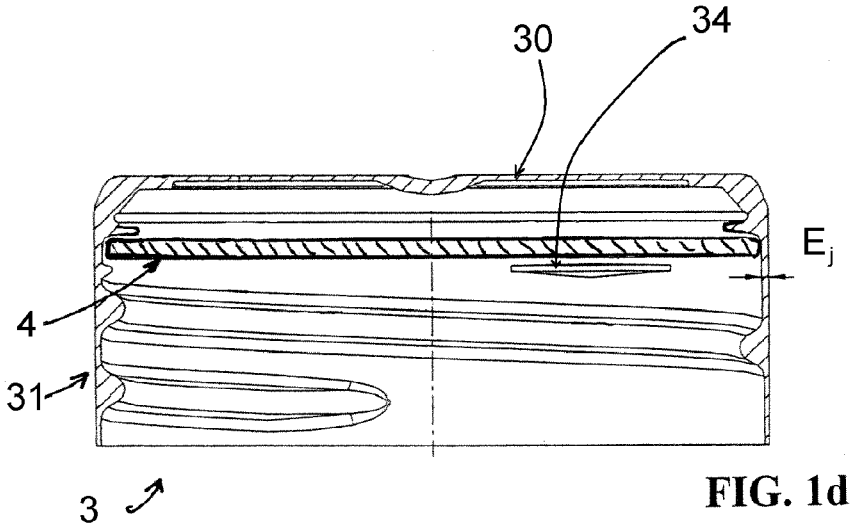
FIG. 1*d* corresponding to FIG. 1*a*, shows an insert (3), the seal (4) being present and fixed to the insert by a plurality of notches or pins (34), typically 3 notches at 120°.

As illustrated in FIG. 1*d*, the said insert (3) may comprise a plurality of notches or retaining pins (34), typically 3 notches arranged at 120° from each other, so as to provide the said lower annular overlap area instead of or in addition to the said thread (33), so as to fix the said seal (4) to the said insert (3).

According to the invention, the said inner skirt (31) of the said insert (3) may have a thickness Ej at the bottom of the thread (33) varying from 0.1 mm to 1 mm, and typically from 0.15 mm to 0.5 mm.

FIG. 1*a* and 1*d* show inserts (3) with skirt thickness Ej equal to 0.3 mm (maximum value).

The said insert (3) may be a threaded and typically moulded insert made of a thermoplastic material, typically chosen from among PS, PET, PA, and polyolefins such as PE or PP. High-impact PS will be used in preference.

Inserts are typically injection moulded.

The said shell (2) may be an aluminium or tin metal shell, or may be made of a crimpable multilayer metalloplastic material.

As illustrated on the right part of FIG. 6, the metal shell is crimped under the glass ring, in the recessed part (63) of the neck (5).

Typically, the said seal (4) may be made of a multilayer material, typically including a compressible central core C made of a thermoplastic material with a density varying from 200 to 500 kg/m$^3$, a lower layer I typically made of polyolefin or possibly an oxygen barrier material designed to come into contact with the said alcoholic drink.

Its thickness e can vary from 0.5 to 3 mm.

According to one embodiment of the invention, the said insert (3) may have a height Hi less than the height Hc of the said shell (2).

The height Hc of the said shell (2) may be at least twice as high as the height Hi of the said insert (3) so as to form a cap with a long skirt as illustrated for example in FIG. 6.

In this case, the said shell (2) may include a means of detecting or facilitating a first opening, typically a line of weakness (22) or a first opening strip formed on the said outer skirt, the said means being located at a height between Hc and Hi, such that the said means is located above the said recessed part (53) of the said neck (5) when the said cap (1) is screwed onto the said neck (5), the said cap (1) being crimped to the said neck (5) by local deformation of the said outer skirt (21) of the said shell (2) in the said recessed part (53), such that the said cap (1) cannot be unscrewed without breaking the line of weakness of removing the said strip.

According to another embodiment of the invention, the height Hi of said insert (3) may be equal to at least the height Hc of the said shell (2) as illustrated in FIG. 7*b*.

In this case, in particular the said insert (3) may include a means of detecting or facilitating a first opening, the said inner skirt of the said insert including an attachment means in its lower part designed to cooperate with the said recessed part when the said cap is screwed and crimped to the said neck.

In FIGS. 7*b* and 7*c*, the insert (3) comprises a line of weakness (36) delimiting a lower part (37) comprising a plurality of hooks (371) designed to cooperate with the said recessed part (53) of the neck, the lower part (37) may include a shoe (370) cooperating with the lower end of the outer skirt (21) of the shell (2).

As soon as the cap (1) is unscrewed as illustrated in FIG. 7*c*, the said lower part (37) separates and appears visibly as such, as an indicator that the cap has been opened for the first time.

According to the invention, the said shell (2) may have a radius of curvature RC of the said shell at the junction between the said outer head and the said outer skirt varying from 0.5 mm to 5 mm, and typically equal to 1.5 mm or 2.5 mm.

As shown in FIG. 4*b*, the said shell (2) may have a radius of curvature RC equal to at least 2 mm, and the said insert (3) may have a radius of curvature Rci typically equal to RC, such that the entire part of the said shell (2) compresses the said insert (3) or is in contact with the said insert (3), and the said insert (3) thus has an improved resistance at high temperature.

It has been observed that the lack of free space between the said shell and the said insert has an influence on the seal if storage or transport conditions can involve relatively high temperature conditions typical of tropical countries.

The applicant considered that the lack of free space, and the fact that the shell forms a binding band for the insert, should limit creep and relaxation of stresses in the insert such that it would consequently be possible for it to keep its mechanical properties and assure the said radial compression even after temperatures are temporarily as high as 40° to 50° C.

Typically, the said insert (3) and the said shell (2) are fixed by force fitting and/or by an adhesive layer fixing the said outer skirt (21) and inner skirt (31) together.

Advantageously, the said adhesive layer is a hot-melt layer.

As shown in FIGS. 5*a* and 5*b*, a complementary element may be fixed to the said insert (3) or to the said seal (4), the said complementary element being designed to remain fixed to the said neck (5) after the said cap (1) has been unscrewed, the said element typically forming a pouring spout (7).

FIGS. 5*a* and 5*b* illustrate the case in which the pouring spout (7) is reversibly fixed to the central part (40) of the seal (4).

The pouring spout (7) may include a typically vertical partition (70) capable of penetrating into the said neck (5) and a flared upper part (71) that pours the contents of the bottle, the partition (70) being provided with a plurality of sealed ribs (72) fixing the pouring spout to the neck (5). This pouring spout (7) includes arms (73) that cooperate with a part (8) by reversible snapping-on. The said part (8) includes a stand (8) sealed to the central part of the seal (40) and a rod (81) carrying a head (82) that cooperates with the end of the ribs (72).

EXAMPLE EMBODIMENTS

All figures correspond to example embodiments according to the invention.

All inserts (3) were made by injection moulding of high-impact PS.

All metal shells were fabricated by drawing a 0.21 mm thick aluminium strip so as to obtain shells with a height Hc typically equal to 60 mm.

The seals were obtained from a material available in the shops made by CORELEN®, in a strip with thickness e of 1.2 mm.

This material comprises a 1 mm thick expanded PE or EPE core, its complete multilayer structure possibly being represented by EPE/Kraft paper/Sn/PVDC, the PVDC layer being in contact with the liquid, intermediate layers of adhesive fixing the adjacent layers if necessary.

EPE/PE/PVDC/PE or PE/PVDC/PE/EPE/PE/PVDC/PE type seals were also used for the tests.

Inserts were assembled in the shells by depositing a hot-melt strip on the inside of the said outer skirt (21), and the said insert (3), typically comprising the said seal, was force fitted until the said inner head (30) stopped in contact with the said outer head (20).

Capping tests were carried out on bottles with glass rings references BVP 30H60 and BVS30H60.

A) Inserts and Caps According to FIGS. 1*a* to 1*d:*

Inserts (3) according to FIG. 1*a* to 1*d* were made, with an outside diameter of 29.3 mm and a height Hi of 11.1 mm. The thickness Ej of the inner skirt (31) at the thread root was taken equal to 0.3 mm, as the maximum nominal value.

These inserts (3) comprise a circular tab (32) at an axial distance h1 of 2.8 mm, the said tab having a radial width 1 equal to 1.55 mm—see FIG. 1*b*. This circular tab (32) has a thinned end or inner part (320) that can bend upwards when screwing the cap onto the neck.

The radius of curvature RCi of these inserts (3) was taken equal to 0.79 mm.

FIG. 1*a* shows a first variant of an insert—the seal (4) being missing—in which the said circular tab (32) and the upper end of the threads (33) define an annular groove (35) with an axial width of 1.4 mm.

On the variant shown in FIG. 1*d*, the lower part of the annular groove (35) is defined by three notches or pins (34) arranged at 120° from each other, only one being shown in FIG. 1*d*.

Figure 2A:
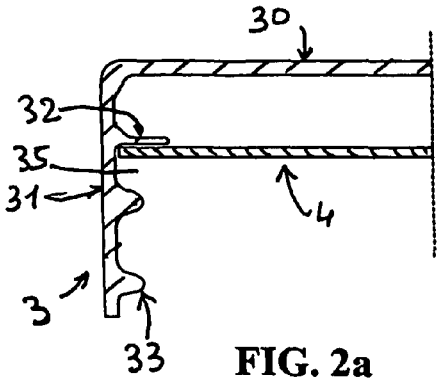
FIG. 2*a* is a left partial axial section of an insert (3) with its seal (4), the seal (4) being fixed to the insert by the inner thread (33).
Figure 2B:
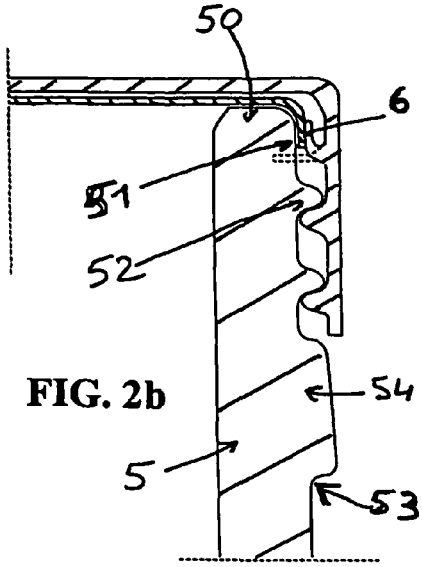
FIG. 2*b* is a right partial axial section of the insert (3) in FIG. 2*a* screwed onto a neck (5)—the metal shell (2) of the cap (1) not being shown.
Figure 2C:
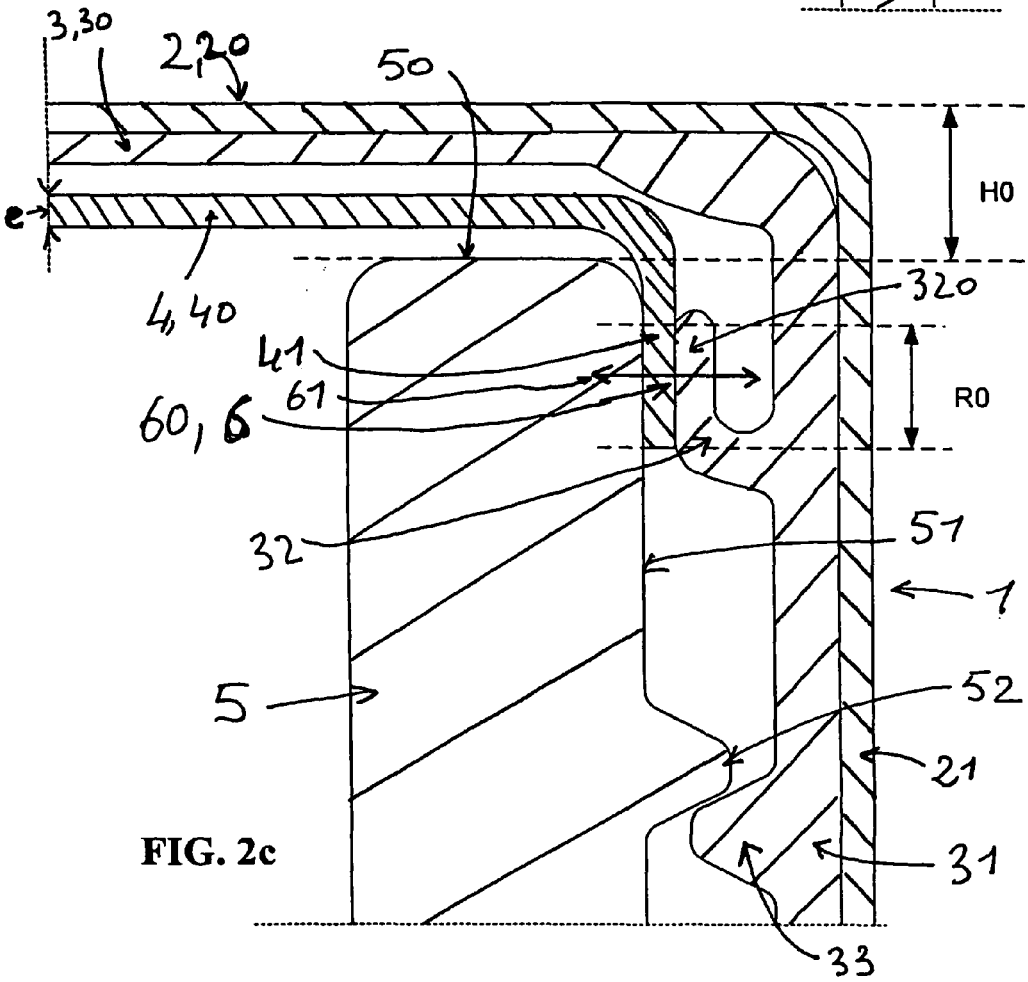
FIG. 2*c* is an enlarged right partial axial sectional view of a cap (1) screwed onto a neck (5) illustrating radial compression (6) of the peripheral edge (41) of the seal (4) in contact with the upper vertical part (51) of the neck (5), by the circular tab (32) in the case in which the cap (1) is at an axial distance H0 from the mouth lip (50) of the neck (5).

B) Inserts and Caps According to FIGS. 2*a* to 2*c:*

An insert (3) with its seal (4) was also shown diagrammatically in FIG. 2*a*, the first insert was shown after screwing onto a neck (5) in FIG. 2*b* to illustrate the said radial compression (6).

FIG. 2*c* shows an enlarged detailed illustration of the radial compression (6) of the border (41) of the seal (4) by the circular tab (32) of the insert (3) clamped in the typically metal shell (2).

In this case, the overlap area (60) between the border (41) and the tab (32) by its radial end (320) is approximately vertical, such that the compression direction (61) makes an angle of approximately 90° from the vertical.

C) Inserts and Caps According to FIGS. 4*a* and 4*b:*

An insert (3) was made with a radius of curvature Rci of 2.5 mm. This insert was also used to make two caps (1), differing from the metal shell (2) by the radius of curvature RC.

The shell (2) in FIG. 4*a* had a radius of curvature RC1 equal to 1.5 mm, while the shell (2) in FIG. 4*b* had a radius of curvature RC2 of 2.5 mm. Thus, a free space (23) was present inside the said shell, between the said shell and the said insert in the case of the shell shown in FIG. 4*a*, while the shell in FIG. 4*b* did not have a space (23).

D) Caps with Pouring Spouts Obtained According to FIGS. 5*a* and 5*b:*

A pouring spout (7) and a part (8) acting as a temporary support for the pouring spout were formed by injection moulding of PE, enabling automatic catering of the pouring spout with respect to the neck. The part (8) was heat-sealed to the central part (40) of the seal (4) that included a lower layer also made of PE.

The said part (8) is fixed to the said pouring spout (7) provided that a minimum axial force is applied, but is typically sufficient so that the said pouring spout does not separate from the said part (8) under its own weight, such that the said seal (4) and the said part (8) remain fixed to the said insert (3) when the said cap is opened, the pouring spout (7) remaining fixed to the neck due to the friction forces generated by the said ribs (72).

E) Inserts and Caps Obtained According to FIG. 7*a:*

Inserts and cap were made such that the angle between the direction of the radial compression (61) after screwing in and capping and the vertical is between 45 and 90°.

F) Inserts and Caps Obtained According to FIGS. 7*b* and 7*c:*

These inserts are moulded with a plurality of tabs forming hooks (371) capable of cooperating with the recessed part (53) located below the mating ring (54) of the neck (5) such that in this case there is no crimping of the outer skirt (21) in the said recessed part (53).

RESULTS OBTAINED

The caps (1) obtained were screwed onto necks as illustrated on the left part of FIG. 6, and screwed to the neck in the case of the tests A to E as illustrated on the right part of FIG. 6.

Figure 3A:
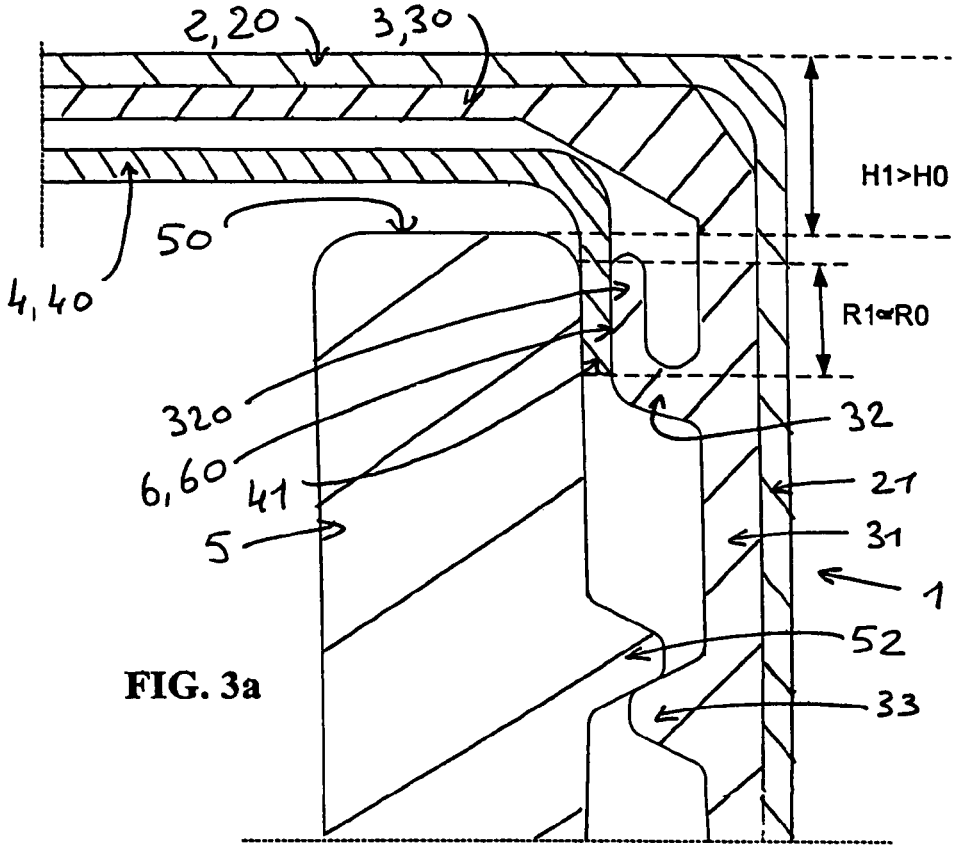
FIGS. 3*a* and 3*b* are similar to FIG. 2*c*.
Figure 3B:
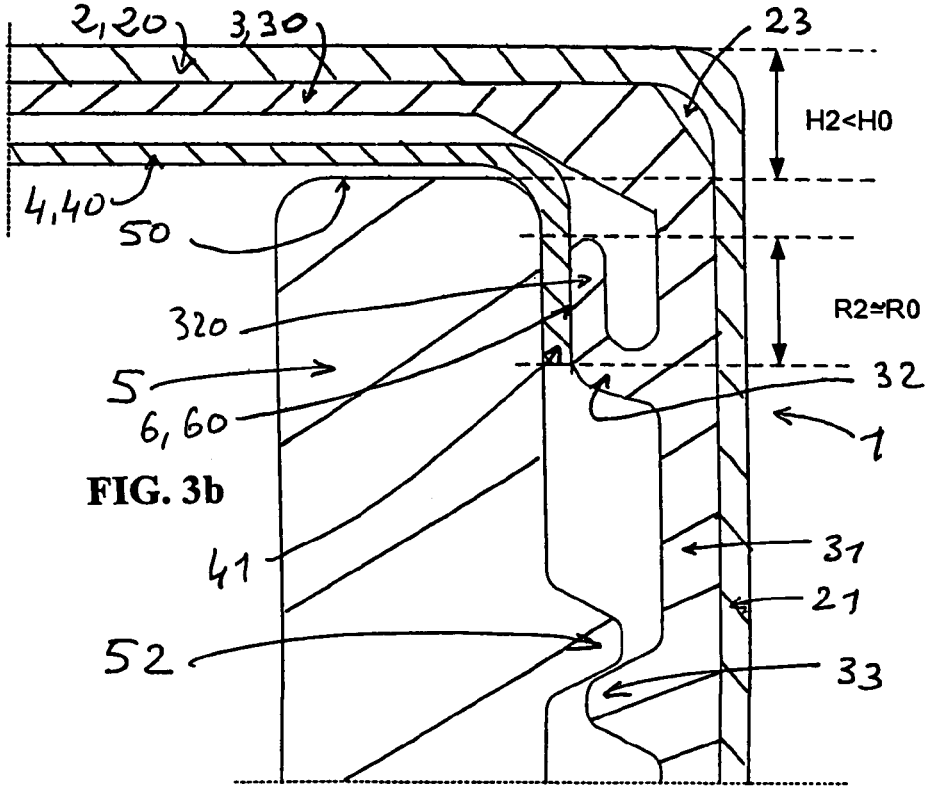

Firstly, as illustrated in FIGS. 2*c*, 3*a* and 3*b*, the applicant observed that the final seal and the unscrewing torque of caps according to the invention are not very sensitive to screwing and crimping conditions, in other words to capping conditions in general, and also that they are not very sensitive to variations in the height of capped bottles.

Thus, contrary to what was observed with screw caps according to the state of the art, the leak tightness and the opening torque to unscrew the cap remain approximately constant throughout a production campaign, regardless of the source of the glass bottles used.

The seal of caps was measured by filling 75 $cm^3$ bottles with red wine with alcohol content of 12° at atmospheric pressure at 20° C., leaving a free volume of 13 $cm^3$ above the wine level. After screwing and crimping the caps on the bottles, the bottles were heated gradually and the temperature at which the first leaks occurred were marked, as a function of the increased pressure in the bottle that was also measured.

| Leak pressure and temperature | Leak pressure | Leak temperature |
|---|---|---|
| STELUXE ® cap according to the state of the art with an axial compression seal | 1.40 bars, namely 0.140 MPa | 45° C. |
| Cap according to the invention as shown in FIGS. 1a and 4b | 2.75 bars, namely 0.275 MPa | 53.5° C. |

All other things being equal, caps according to the invention had a very much better seal than caps according to the state of the art.

Furthermore, storage tests at ambient temperature and at 50° showed that the opening torque was within the range varying from 11 to 13 lbs/inch, namely 1.24 to 1.47 N.m, while the cap according to the state of the art required a much higher torque:

| Opening torque in lb. inches and in N.m | At ambient temperature (after putting in the drying oven at the leak temperature) |
|---|---|
| STELUXE ® cap according to prior art | From 14 to 17 lb/inches namely 1.58 to 1.92 N.m |
| Cap according to the invention As shown in FIGS. 1a and 4b | From 11 to 13 lb/inches namely 1.24 to 1.47 N.m |

Furthermore, having increased the reliability of capping, the applicant observed that capping rates with caps according to the invention could be increased by about 10% without any risk of seal defects appearing.

The applicant also observed that it is possible to obtain a good seal without the need for a high opening torque, as is the case with caps according to the state of the art.

Thus, even elderly persons are capable of unscrewing caps according to the invention.

Finally, the applicant has observed that caps (1) according to the invention could have a better seal at "high temperature" using caps of the type shown in FIG. 4*b* in which the said shell and the said insert each have a relatively high radius of curvature. Caps according to the invention can thus be used everywhere in the world, regardless of local weather conditions.

ADVANTAGES OF THE INVENTION

As is clear from the above, screw caps according to the invention have major advantages over caps according to the state of the art, and they do not introduce any extra manufacturing costs and they use the same production techniques and materials as caps according to prior art.

These advantages may be summarised as follows:

- high seal not very dependent on dimensional variations of bottles and capping conditions,
- a tight seal throughout the required temperature range,
- constant first opening torque, significantly less than the torque level necessary for caps according to the state of the art,
- increased capping rates.
- use for capping wine, alcohol, spirit and aperitif bottles.

| LIST OF MARKS | |
|---|---|
| Screw closing cap | 1 |
| Vertical axial direction | 10 |
| Metal shell | 2 |
| Outer head | 20 |
| Outer skirt | 21 |
| Line of weakness | 22 |
| Free space | 23 |
| Plastic insert | 3 |
| Inner head | 30 |
| Inner skirt | 31 |
| Circular tab | 32 |
| Flexible radial end | 320 |
| Thread | 33 |
| Notch or seal retaining pin | 34 |
| Annular groove | 35 |
| Line of narrow connecting strips | 36 |
| Lower part | 37 |
| Heel | 370 |

-continued

| LIST OF MARKS | |
|---|---|
| Hook | 371 |
| Seal | 4 |
| Central part | 40 |
| Peripheral edge | 41 |
| Bottle neck | 5 |
| Mouth lip | 50 |
| Upper part | 51 |
| Threaded part or thread | 52 |
| Recessed crimping part | 53 |
| Mating ring | 54 |
| Radial compression of 41 in contact with 51 | 6 |
| Overlap area between 41 and 320 | 60 |
| Compression direction | 61 |
| Pouring spout | 7 |
| Vertical partition | 70 |
| Flared upper part | 71 |
| Fixing ribs to the neck 5 | 72 |
| Reversible fixing arm to 8 | 73 |
| Support part of 7 sealed or welded to 40 | 8 |
| Bottom | 80 |
| Rod | 81 |
| Head | 82 |

The invention claimed is:

1. A screw closing cap, designed to cooperate with a neck of a receptacle, said neck forming a mouth lip on an upper part and comprising an outer thread on a sidewall and a recessed part on which said cap will be crimped, said cap comprising:

an outer shell, an insert, said insert being contained in said outer shell and being fixed to said outer shell and comprising an inner head forming a bottom of said insert and an inner skirt provided with an inner thread that cooperates with the outer thread of said neck, and a seal forming an add-on part fixed to said insert, said seal comprising a central part and a peripheral edge, wherein said inner skirt comprises a circular tab that is axial spaced from said inner head, so as to form an annular groove with an axial height equal to at least a thickness of said seal, said annular groove being limited at a top part by said circular tab and at a lower part by said thread, a diameter of said seal is such that said peripheral edge cooperates with said annular groove, said seal having annular overlap areas with said tab, so that said seal remains fixed to said insert before said cap is screwed onto said neck, or after said cap is unscrewed from said neck, said circular tab has a flexible radial end and a radial width such that, when said cap is screwed onto said neck, said flexible radial end of the said circular tab and said peripheral edge of said seal simultaneously bend from positions that are substantially parallel to each other, said circular tab applying a radial compression on said peripheral edge, so as to apply said peripheral edge in contact with said neck, forming an overlap area inclined at more than 45° from the horizontal between said peripheral edge and said flexible radial end, thus sealing said cap screwed to said neck.

2. The cap according to claim 1 in which said insert comprises a plurality of notches or retaining pins, so as to fix said seal to said insert.

3. The cap according to claim 1, in which a thickness of said inner skirt of said insert at a bottom of the thread is between 0.15 mm and 0.5 mm.

4. The cap according to claim 1 in which said insert is a threaded and moulded insert made of a thermoplastic material.

5. The cap according to claim 1 in which said shell is an aluminium or tin metal shell, made of a crimpable multilayer metalloplastic material.

6. The cap according to claim 1 in which said insert has a height less than a height of said shell.

7. The cap according to claim 6 in which the height of said shell is at least twice as high as the height of said insert so as to form a cap with a long skirt.

8. The cap according to claim 7 in which the said shell comprises a means of detecting or facilitating a first opening, said means being located at a height between the height of said shell and the height of the insert, such that said means is located above said recessed part of said neck when said cap is screwed onto said neck, said cap being crimped to said neck by local deformation of said outer skirt of said shell in said recessed part, such that said cap cannot be unscrewed without breaking said means of detecting or facilitating a first opening.

9. The cap according to claim 1 in which said insert includes a means of detecting or facilitating a first opening, said inner skirt of the said insert including an attachment means in a lower part designed to cooperate with said recessed part when said cap is screwed and crimped to said neck.

10. The cap according to claim 1 in which said shell has a radius of curvature RC of the said shell at a junction between said outer head and said outer skirt between 1.5 mm and 2.5 mm.

11. The cap according to claim 10 in which said shell has a radius of curvature RC equal to at least 2 mm, and said insert has a radius of curvature RCi substantially equal to RC, such that an entire part of said shell compresses said insert or is in contact with said insert, and said insert thus has an improved resistance at high temperature.

12. The cap according to claim 1 in which said insert and said shell are fixed by at least one of force fitting and an adhesive layer fixing said outer skirt and inner skirt together.

13. The cap according to claim 1 in which a complementary element is fixed to said insert or to said seal, said complementary element being designed to remain fixed to said neck after said cap has been unscrewed, said complementary element forming a pouring spout.

14. The cap according to claim 2, in which a thickness of said inner skirt of said insert at a bottom of the thread is between 0.15 mm and 0.5 mm.

15. A screw closing cap, configured to cooperate with a neck of a receptacle, said neck forming a mouth lip on an upper part and comprising an outer thread on a sidewall and a recessed part on which said cap is to be crimped, said cap comprising:

an outer shell, an insert contained in said shell and being fixed to said shell and comprising an inner head and an inner skirt provided with an inner thread designed to cooperate with the outer thread of said neck, and a horizontal seal forming an add-on part fixed to said insert, said seal comprising a central part and a peripheral edge, said inner skirt comprises a circular tab with an axial spacing from said inner head, so as to form an annular groove, said annular groove being delimited at a top part by said circular tab and at a lower part by said thread, a diameter of said seal is such that said peripheral edge cooperates with said annular groove, said seal having an annular overlap area with said tab, so that said seal remains fixed to said insert before said cap is screwed onto said neck, or after said cap is unscrewed from said neck, said circular tab has a flexible radial end such that, when said cap is screwed onto said neck, said flexible radial end bends from a horizontal first position to a second position and said peripheral edge simultaneously bends from a position substantially parallel with said flexible radial end so that the flexible radial end forms an overlap area with said peripheral edge inclined at more than 45° from the horizontal.

* * * * *